US011479043B2

(12) United States Patent
Kajiya et al.

(10) Patent No.: US 11,479,043 B2
(45) Date of Patent: Oct. 25, 2022

(54) PRINTING APPARATUS FOR PRINTING BY DISCHARGING INK TO AN UPPER SURFACE OF A BASE MATERIAL IN THE FORM OF AN ELONGATED STRIP

(71) Applicant: SCREEN HOLDINGS CO., LTD., Kyoto (JP)

(72) Inventors: Hiroyuki Kajiya, Kyoto (JP); Ichiro Hassaka, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 17/180,054

(22) Filed: Feb. 19, 2021

(65) Prior Publication Data

US 2021/0291529 A1 Sep. 23, 2021

(30) Foreign Application Priority Data

Mar. 23, 2020 (JP) ..... JP2020-051336

(51) Int. Cl.
*B41J 2/165* (2006.01)

(52) U.S. Cl.
CPC ..... *B41J 2/16511* (2013.01)

(58) Field of Classification Search
CPC ..... B41J 2/16511; B41J 2/16523; B41J 2/16508; B41J 2/165; B41J 2002/16502
See application file for complete search history.

(56) References Cited

U.S. PATENT DOCUMENTS

| | | | | |
|---|---|---|---|---|
| 6,709,087 | B2 | 3/2004 | Ansell et al. | |
| 2016/0200106 | A1 | 7/2016 | Nakano | |
| 2016/0207315 | A1 | 7/2016 | Tsuzawa | |
| 2017/0266964 | A1 * | 9/2017 | Hattori | B41J 2/04586 |

FOREIGN PATENT DOCUMENTS

| | | | | |
|---|---|---|---|---|
| EP | 1 375 157 | A1 | 1/2004 | |
| JP | 2014-008639 | A | 1/2014 | |
| JP | 2019-119609 | A | 7/2019 | |
| WO | WO-2015046196 | A1 * | 4/2015 | B41J 2/16505 |
| WO | 2019/131843 | A1 | 7/2019 | |

OTHER PUBLICATIONS

Extended European Search Report issued in corresponding European Patent Application No. 21158230.9-1017, dated Aug. 5, 2021.

* cited by examiner

*Primary Examiner* — Sharon Polk
(74) *Attorney, Agent, or Firm* — McDermott Will & Emery LLP

(57) ABSTRACT

Since a head part is arranged in an inclined posture, the ink ejected from a nozzle surface of the head part may drip to a first lower surface peripheral edge portion along the nozzle surface, and then drops from a first long side of a lower surface of the head part toward a first side wall of a cover member being arranged below the head part. The first side wall having an upper end portion is located away from the first long side. Thus, the dropped ink is collected by the cover member without being attached to the upper end portion of the first side wall. Therefore, the ink can be prevented from being solidified at the first lower surface peripheral edge portion and the reattachment of the ink to the nozzle surface can be effectively prevented.

11 Claims, 5 Drawing Sheets

PRINTING APPARATUS FOR PRINTING BY DISCHARGING INK TO AN UPPER SURFACE OF A BASE MATERIAL IN THE FORM OF AN ELONGATED STRIP

CROSS REFERENCE TO RELATED APPLICATION

The disclosure of Japanese Patent Application No. 2020-051336 filed on Mar. 23, 2020 including specification, drawings and claims is incorporated herein by reference in its entirety.

BACKGROUND OF THE INVENTION

1. Field of the Invention

This invention relates to a printing apparatus for printing by discharging an ink to the upper surface of a base material.

2. Description of the Related Art

A printing apparatus is known which prints an image on the upper surface of a base material by ejecting an ink such an aqueous or oil-based ink from a head part to the base material by an ink-jet method. For example, in a printing apparatus described in JP 2019-119609A, a plurality of head parts each having a nozzle surface on a lower surface are arrayed along a printing path for a base material. Each head part prints by ejecting an ink in the form of droplets to the upper surface of the base material from the nozzle surface. Thus, if deposits attached to the nozzle surfaces are dried and solidified, the clogging of nozzles occurs to reduce printing performance. Accordingly, although not described in JP 2019-119609A, various maintenance operations are performed with the entire nozzle surfaces covered from below by box-shaped cover members open to face the lower surfaces of the head parts in this printing apparatus. One of the maintenance operations is an ink purging process. One of main purposes of this purging process is to prevent deposits attached to the nozzle surfaces of the head parts from being dried and solidified and push out the ink at every certain time.

SUMMARY OF THE INVENTION

In some of the head parts equipped in the printing apparatus described in JP 2019-119609A, printing is performed in such a posture that a normal to the nozzle surface is inclined with respect to a vertical direction (hereinafter, referred to as an "inclined posture"). Further, the purging process is also performed in the inclined posture. Thus, the ink may drip along the inclined nozzle surface before dropping from the nozzle surface during the purging process. The thus dripped ink is attached to an upper part of a side wall of the cover member open to face the lower surface of the head part and causes various troubles. For example, if the ink deposits and is solidified and part thereof is transferred to the nozzle surface, it leads to a reduction in printing quality.

This invention was developed in view of the above problem and aims to effectively prevent the reattachment of an ink to a nozzle surface in a printing apparatus for printing by ejecting the ink to the upper surface of a base material from the nozzle surface provided in a head part in an inclined posture.

One aspect of the invention is a printing apparatus for printing by discharging an ink to an upper surface of a base material in the form of an elongated strip. The apparatus comprises: a head part provided with a nozzle surface for ejecting the ink in a central part of a lower surface having a rectangular shape; and a cover member having a box shape open upward by having a plurality of side walls rising upward from a periphery of an inner bottom surface, the cover member covering the nozzle surface from below by being arranged below the head part, wherein: the lower surface has a first short side and a second short side parallel to a longitudinal direction of the base material and a first long side and a second long side parallel to a width direction of the base material, the head part is arranged in such an inclined posture that the first long side is located below the second long side in a vertical direction and a first lower surface peripheral edge portion extending along the first long side, out of a peripheral edge part of the lower surface, is located vertically lowest, and the plurality of side walls include a first side wall having an upper end portion located away from the first long side toward a side opposite to the second long side in the longitudinal direction.

According to this invention, since the head part is arranged in the inclined posture, the ink ejected from the nozzle surface may drip to the first lower surface peripheral edge portion along the nozzle surface, for example, if a purging process or the like is performed. Accordingly, the first side wall, which is one of the side walls constituting the cover member, is so provided that the upper end portion is located away from the first long side toward the side opposite to the second long side in the longitudinal direction. Thus, the ink dripped to the first lower surface peripheral edge portion drops from the first long side by the self-weight thereof after reaching the first long side of the lower surface of the head part, and is collected by the cover member without being attached to the upper end portion of the first side wall. Therefore, the ink can be prevented from being solidified at the first lower surface peripheral edge portion and the reattachment of the ink to the nozzle surface can be effectively prevented.

All of a plurality of constituent elements of each aspect of the invention described above are not essential and some of the plurality of constituent elements can be appropriately changed, deleted, replaced by other new constituent elements or have limited contents partially deleted in order to solve some or all of the aforementioned problems or to achieve some or all of effects described in this specification. Further, some or all of technical features included in one aspect of the invention described above can be combined with some or all of technical features included in another aspect of the invention described above to obtain one independent form of the invention in order to solve some or all of the aforementioned problems or to achieve some or all of the effects described in this specification.

DESCRIPTION OF EMBODIMENTS

Figure 1:
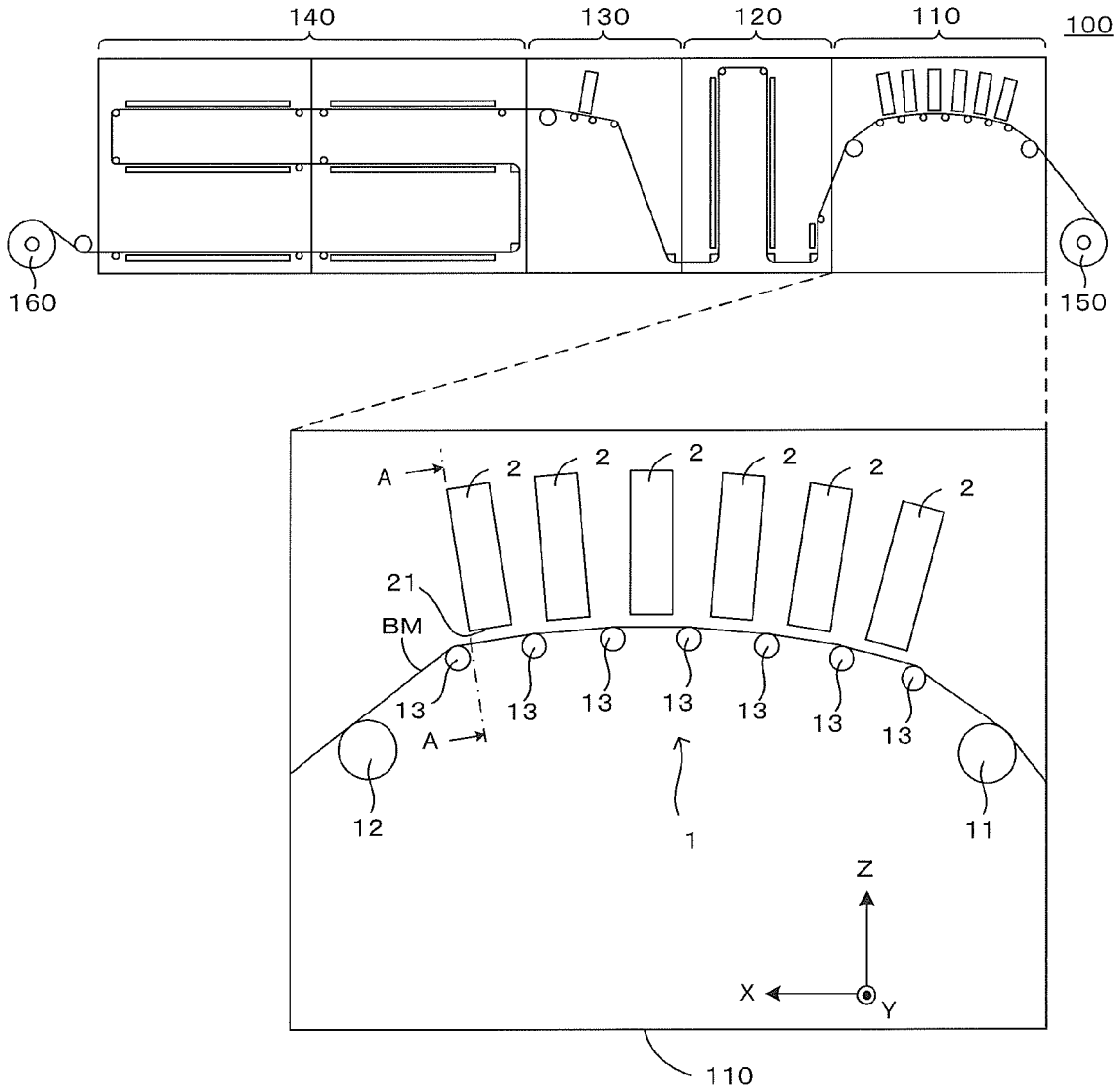
FIG. 1 is a diagram schematically showing a first embodiment of a printing apparatus according to the invention.

FIG. 1 is a diagram schematically showing a first embodiment of a printing apparatus according to the invention. This printing apparatus 100 is an apparatus for printing by ejecting inks to the upper surface of a base material BM while conveying the base material BM in the form of an elongated strip in a roll-to-roll method. The base material BM is one of various print materials such as paper or films. Note that a width direction of the base material BM is referred to as a "Y direction" and a horizontal direction orthogonal to the Y direction is referred to as an "X direction" to clarify an arrangement relationship of each component of the apparatus in each of the following figures. Further, a vertical direction is referred to as a "Z direction".

In the printing apparatus 100, as shown in FIG. 1, a front-stage printer 110, a front-stage dryer 120, a rear-stage printer 130 and a rear-stage dryer 140 are arrayed in this order in the horizontal direction X at the same height. Further, in this printing apparatus 100, the base material BM is conveyed in a roll-to-roll manner from a feeding roll 150 to a winding roll 160. The printing apparatus 100 dries the base material BM printed in the front-stage printer 110 in the front-stage dryer 120 and further dries the base material BM printed in the rear-stage printer 130 in the rear-stage dryer 140.

The front-stage printer 110 includes a conveyor 10 for conveying the base material BM from right to left as shown in a partial enlarged view in FIG. 1. The conveyor 10 includes a carry-in roller 11 for carrying the base material BM paid out from the feeding roll 150 into a housing of the front-stage printer 110 and a carry-out roller 12 for carrying out the base material BM toward the front-stage dryer 120. The carry-in roller 11 and the carry-out roller 12 drive the base material BM while being held in contact with the back surface of the base material BM from below. Further, a plurality of backup rollers 13 are provided between the carry-in roller 11 and the carry-out roller 13. Each of these backup rollers 13 supports the base material BM from below by being held in contact with the back surface of the base material BM from below.

Out of the plurality of backup rollers 13, the most upstream backup roller 13 and the most downstream backup roller 13 in a conveying direction are at the same height position, and front-stage printing is performed between these rollers. That is, a path between these two backup rollers 13, 13 is set as a front-stage printing path. The plurality of backup rollers 13 are arranged at certain intervals along the front-stage printing path. These plurality of backup rollers 13 are arranged at a higher position toward a central part of the front-stage printing path and support the base material BM. As a result, the conveying direction of the base material BM is not constant. The conveying direction of the base material BM is obliquely upward with respect to the horizontal direction X in a first half of the front-stage printing path, substantially parallel to the horizontal direction X in the central part and obliquely downward with respect to the horizontal direction X in a second half. That is, the conveyor 10 can continuously convey the base material BM in the form of an elongated strip by an upward projecting substantially arcuate front-stage printing path.

A plurality of head parts 2 for printing by ejecting the ink to the upper surface of the base material BM being conveyed in this way are arranged along the front-stage printing path. More specifically, the head part 2 is arranged at a position above the upper surface of the base material BM moving between two backup rollers 13 adjacent to each other. Each head part 2 ejects the ink to the printed surface of the base material BM having both sides supported by two backup rollers 13 in an ink-jet method. In an example shown here, six head parts 2 including four head parts 2 for ejecting ink of four process colors (yellow, magenta, cyan, black) and two head parts 2 for ejecting ink of two specific colors (orange, violet, green, etc.) are provided. Each head part 2 has a nozzle surface for ejecting the ink on a lower surface, and ejects the ink from this nozzle surface to the upper surface of the base material BM being conveyed along the substantially arcuate conveyance path. Therefore, as will be described in detail later, the head part 2 is arranged in an inclined posture according to the conveying direction of the front-stage printing path.

Figure 2:
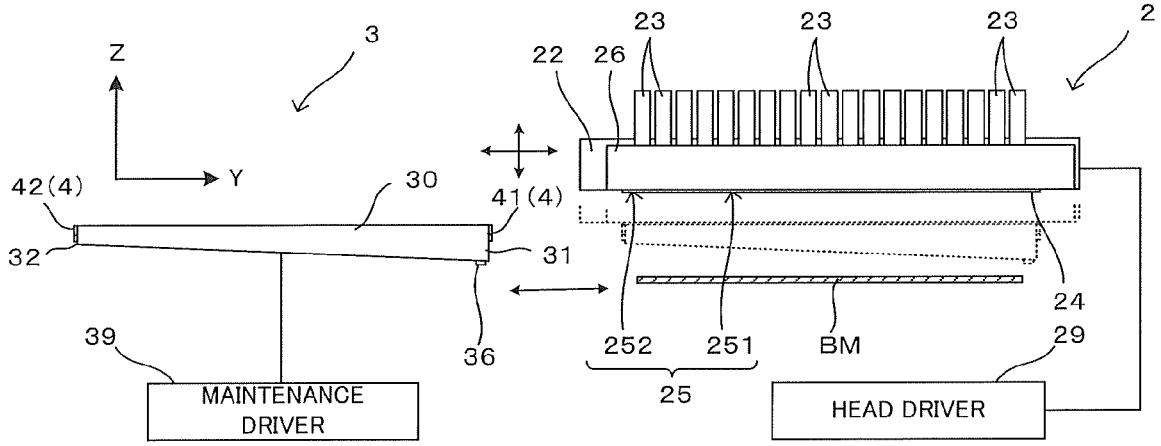
FIG. 2 is a view along arrow line A-A in FIG. 1.

FIG. 2 is a view along arrow line A-A in FIG. 1. As shown in FIG. 2, the head parts 2 are arranged at positions above the base material BM conveyed along the front-stage printing path. Each head part 2 is provided to be movable upward and downward in a direction parallel to a surface normal to the upper surface of the base material BM, and connected to a head driver 29. Thus, the head driver 29 operates in response to an elevation command from a controller (not shown) for controlling the entire apparatus, whereby the head part 2 is driven to move upward and downward among a print position, a retracted position and a maintenance position. The print position is a position where the head part 2 is proximate to the upper surface of the base material BM to perform printing as shown in FIG. 1. The retracted position is a position where the head part 2 is largely retracted from the print position as shown in a solid line of FIG. 2. The maintenance position is a position between the print position and the retracted position as shown in a dotted line of FIG. 2. Further, the head driver 29 operates in response to a head horizontal command, whereby the head part 2 is moved in the width direction Y of the base material BM.

Here, the "maintenance position" means a position where maintenance is performed for the head part 2. Each head part 2 ejects the ink from the nozzle surface in a so-called ink-jet method. Thus, if a printing process is performed for a long time, a nozzle eject failure gradually occurs. Further, when printing is temporarily stopped, the ink attached to the nozzle surface may be solidified to cause a eject failure. Accordingly, before printing is resumed, the head part 2 is positioned at the maintenance position slightly higher than the printing position. Further, a maintenance part 3 performs various types of maintenance for the nozzle surface of the head part 2.

The maintenance part 3 has a function of performing a purging process and a wiping process for the head part 2 having a nozzle with a eject failure, and is provided for each head part 2. The maintenance part 3 is connected to a maintenance driver 39. Thus, the maintenance driver 39 operates in response to a horizontal movement command from the controller, thereby moving in the width direction Y of the base material BM. More particularly, the maintenance part 3 reciprocally moves between a standby position (solid-line position of FIG. 2) separated in the Y direction from the base material BM and a maintenance position (dotted-line position of FIG. 2) between the head part 2 located at a retracted position (solid-line position of FIG. 2) and the base material BM. Especially, the head part 2 is moved from the retracted position to the maintenance position by the head driver 29 after the maintenance part 3 is positioned at the maintenance position by the maintenance driver 39, whereby the nozzle surface of the head part 2 is capped from below by a cover member 30 of the maintenance part 3. As just described above, in this embodiment, the head driver 29 and the maintenance driver 39 function as a "mover" of the invention and switches to a printing state and a maintenance state by controlling the positions of the head part 2 and the maintenance part 3. Note that any of six head parts 2 has the same structure, and any of six maintenance parts 3 also has the same structure. Accordingly, the configurations, operations and the like of the head part 2 and the maintenance part 3 are described below, focusing on the head part 2 and the maintenance part 3 located on a most downstream side in the conveying direction.

Here, the "printing state" means a state where the head part 2 is positioned at the print position so that a nozzle surface 21 is right above and proximate to the base material BM as shown in a partial enlarged view in FIG. 1 and the maintenance part 3 is positioned at the retracted position separated in the Y direction from a position above the base material BM as shown in a solid line in FIG. 2. In this printing state, the printing process is performed by ejecting the ink from the nozzle surface 21 to the upper surface of the base material BM. On the other hand, the "maintenance state" is a state where the maintenance part 3 is positioned right above the front-stage printing path for the base material BM as shown in a dotted line in FIG. 2, and the head part 2 moves downward to the maintenance part 3 and the nozzle surface 21 is sealed from outside by the maintenance part 3. In this maintenance state, the purging process is performed by the maintenance part 3.

Figure 3A:
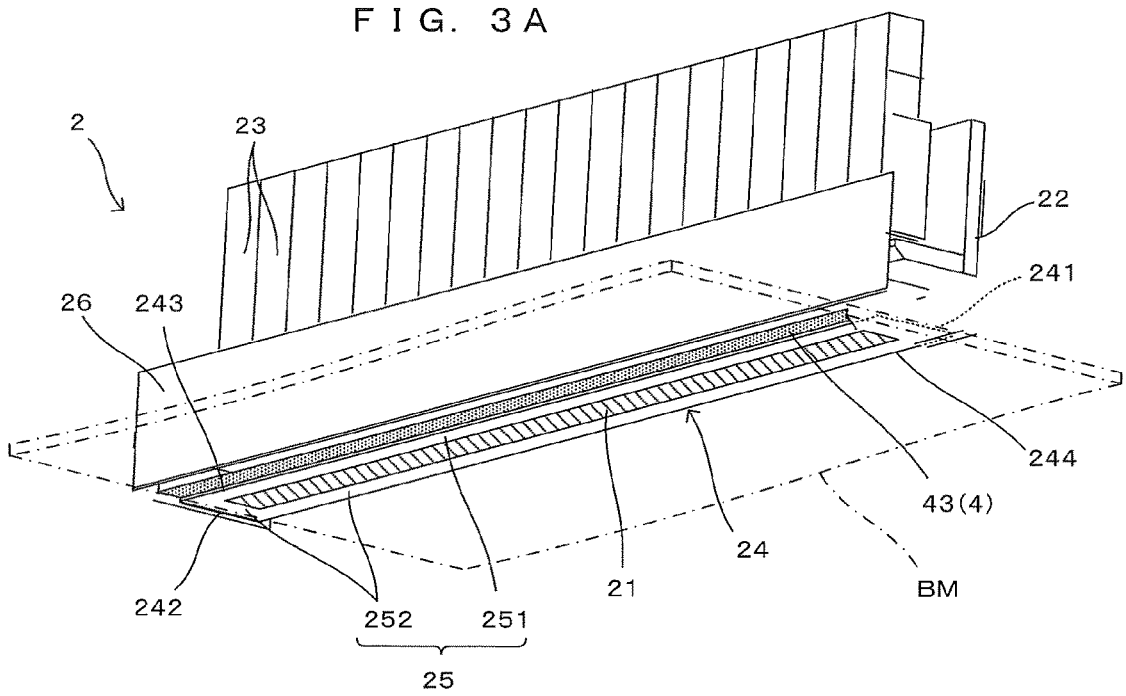
FIG. 3A is a perspective view showing the configuration of the head part.
Figure 3B:
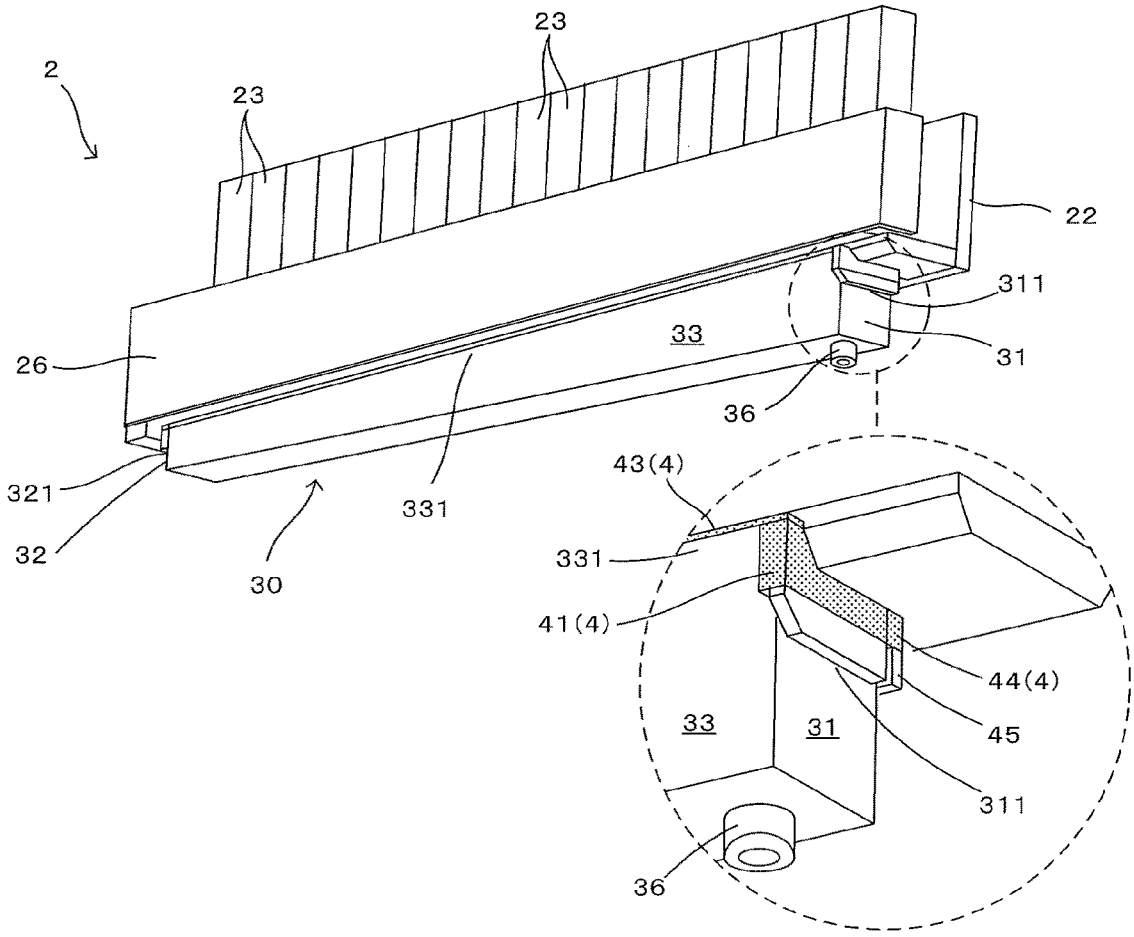
FIG. 3B is a perspective view showing the configuration of the head part, the maintenance part and an airtight controller in the maintenance state.
Figure 4:
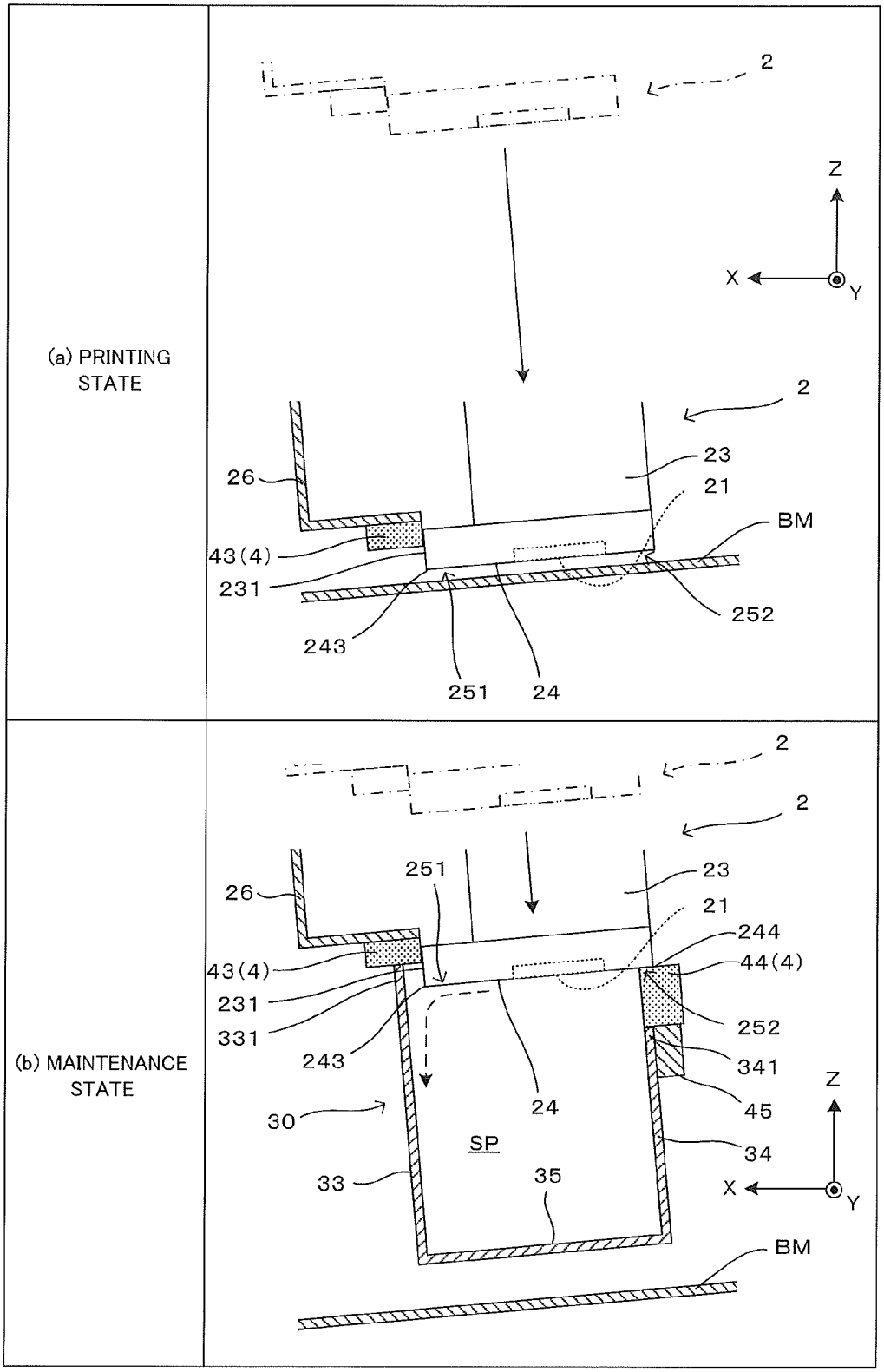
FIG. 4 is a diagram schematically showing the operations of the head part, the maintenance part and the airtight controller.

FIG. 3A is a perspective view showing the configuration of the head part 2 when the head part 2 in the printing state is viewed from the side of the front-stage printing path for the base material BM. FIG. 3B is a perspective view showing the configuration of the head part, the maintenance part and an airtight controller in the maintenance state. FIG. 4 includes views schematically showing the operations of the head part, the maintenance part and the airtight controller. The head part 2 is so arranged that a normal to the nozzle surface 21 in this printing state is parallel to the normal to the upper surface of the base material BM and, in this embodiment, the head part 2 is in a posture inclined with respect to the vertical direction Z to correspond to the front-stage printing path for the base material BM set to have a substantially arcuate shape. More particularly, the head part 2 is configured as follows.

The head part 2 includes a head base 22 inclined with respect to the vertical direction Z. The head base 22 extends in parallel to the width direction Y of the base material BM. Recording heads 23 having nozzles on lower surfaces are fixed to a side surface of this head base 22 while being arrayed in the Y direction. In this way, a lower surface 24 of the head part 2 has a rectangular shape when viewed from the base material BM. More particularly, the lower surface 24 has short sides 241, 242 parallel to a longitudinal direction of the base material BM and long sides 243, 244 parallel to the width direction Y of the base material BM.

A central part of the lower surface 24 having such a rectangular shape serves as the nozzle surface 21 for ejecting the ink. Further, a region excluding the nozzle surface 21, out of the lower surface of the head part 2, i.e. a region surrounding the nozzle surface 21, serves as a peripheral edge part 25 which does not eject the ink. Further, since the head part 2 is arranged in the inclined posture to correspond to the front-stage printing path for the base material BM, the long side 243 is located below the long side 244 in the vertical direction Z as shown in FIG. 4. Thus, a peripheral edge portion 251 along the long side 243, out of the peripheral edge part 25, is located vertically lowest. Note that the nozzle surface 21 is hatched to clearly distinguish the nozzle surface 21 and the peripheral edge part 25 in FIG. 3A. Further, in this specification, the peripheral edge portion 251 and a peripheral edge portion 252 are respectively referred to as a "first lower surface peripheral edge portion 251" and a "second lower surface peripheral edge portion 252" as appropriate to distinguish the peripheral edge portion 251 and the peripheral edge portion 252 other than the peripheral edge portion 251.

In the head part 2, to protect the plurality of recording heads 23, a guard member 26 is mounted on a side opposite to the head base 22 across the plurality of recording heads 23 as shown in FIGS. 3A and 3B. Thus, the head base 22, the plurality of recording heads 23 and the guard member 26 are integrally moved upward and downward by the head driver 29 with the nozzle surface 21 facing down.

The maintenance part 3 includes the box-shaped cover member 30 open upward. As shown in FIG. 4, an upper end part of the cover member 30 is longer than the lower surface 24 of the head part 2 in an extending direction of the short sides 241, 242 (i.e. direction parallel to the longitudinal direction of the base material BM). Further, as shown in FIGS. 2 and 3B, the upper end part of the cover member 30 is longer than the nozzle surface 21 and shorter than the lower surface 24 of the head part 2 in an extending direction of the long sides 243, 244 (i.e. direction parallel to the width direction Y of the base material BM).

Further, as shown in FIG. 4, the cover member 30 has an opening of a size sufficient to cover the nozzle surface 21 and an inner bottom surface 35 facing this opening. This inner bottom surface 35 has a rectangular shape when viewed from the opening side of the cover member 30. More particularly, the inner bottom surface 35 has two short sides parallel to the extending direction of the short sides 241, 242 of the lower surface 24 of the head part 2 (i.e. direction parallel to the longitudinal direction of the base material BM) and two long sides parallel to the extending direction of the long sides 243, 244 (i.e. direction parallel to the width direction Y of the base material BM). Side walls 31 to 34 respectively rise from those four sides of the inner bottom surface 35. In this way, a collection space SP for collecting the ink ejected from the nozzle surface 21 by the purging process as described later is formed. Note that the inner bottom surface 35 is finished into an inclined surface inclined vertically downward along the width direction Y as shown in FIG. 2, so that the ink flowing along the inclined surface can be collected and recovered via a drain pipe 36.

If the cover member 30 having such a configuration is arranged at the maintenance position by the maintenance driver 39, each part of the cover member 30 is positioned as below to cover the nozzle surface 21 of the head part 2 from below. Specifically, as shown in a dotted line of FIG. 2, upper end portions 311, 321 (FIG. 3B) of the side walls 31, 32 of the cover member 30 in the width direction Y face the second lower surface peripheral edge portion 252 of the lower surface 24 of the head part 2. Further, as shown in FIG. 4, an upper end portion 341 of the side wall 34 of the cover member 30 faces the second lower surface peripheral edge portion 252, similarly to the upper end portions 311, 321. On the other hand, an upper end portion 331 of the side wall 33 of the cover member 30 is separated from the lower surface 24 of the head part 2 in a direction (oblique direction toward a left-lower side of FIG. 4) parallel to the longitudinal direction of the base material BM. That is, the upper end portion 331 is located away from the long side 243 of the head part 2 toward a side opposite to the long side 244 in the longitudinal direction.

If the head part 2 is moved downward to the maintenance position where the purging process is performed by the head driver 29 after the cover member 30 is arranged at the maintenance position below the head part 2 located at the retracted position, the lower surface 24 of the head part 2 comes closer to the cover member 30. More particularly, as shown in a field (b) of FIG. 4, the upper end portions 311, 321 and 341 of the cover member 30 are positioned in proximity to the second lower surface peripheral edge portion 252 and the upper end portion 331 is positioned to project further upward than the lower surface 24 while being separated from the lower surface 24 of the head part 2. In this way, the nozzle surface 21 of the head part 2 is covered from below by the cover member 30. Accordingly, even if the purging process is performed in the inclined posture, the ink dripping to the first lower surface peripheral edge portion 251 along the nozzle surface 21 reaches the long side 243 and drops from this long side 243 by the self-weight thereof. The ink can be collected by the cover member 30 without being attached to the upper end portion 331 of the side wall 33.

In this embodiment, the airtight controller 4 for enhancing the airtightness of an atmosphere surrounding the nozzle surface 21 is provided not only to merely collect the ink by the cover member 30, but also to satisfactorily perform maintenance such as the purging process. Here, the airtight controller 4 seals the nozzle surface 21 from outside using contact members 41 to 44, which are elastic bodies, and rubber sponges are used as an example of the elastic bodies. The contact members 41 to 44 respectively correspond to the four side walls 31 to 34 of the cover member 30, and the contact members 41, 42 and 44 are mounted on the cover member 30, whereas the contact member 43 is mounted on the head part 2. Note that, in FIGS. 3A, 3B and 4, the contact members 41 to 44 are dotted to clarify the contact members 41 to 44.

As shown in a partial enlarged view of FIG. 3B, the contact member 41 is mounted on the side wall 31 by a support member 45 in such a posture as to project upward from the upper end portion 311 of the side wall 31. Further, the contact members 42, 44 are also supported by the support member 45 in such a posture as to respectively project upward from the upper end portions 321, 341, basically similarly to the contact member 41. Furthermore, as shown in the same partial enlarged view, one end part of the contact member 44 is in contact with the contact member 41, and the other end part thereof is also in contact with the contact member 42 although not shown. On the other hand, the contact member 43 is mounted on the head part 2 as shown in FIGS. 3A, 3B and 4. More particularly, as shown in FIG. 4, the contact member 43 is mounted on the guard member 26 of the head part 2 while being held in close contact with a side surface part 231 of each recording head 23 with the lower surface thereof facing toward the upper end portion 331.

In performing printing in the printing apparatus 100 thus configured, the head part 2 and the maintenance part 3 are in the printing state. That is, the head part 2 is positioned above the front-stage printing path for the base material BM and the maintenance part 3 waits at a position separated in the width direction Y from the front-stage printing path. Thus, as shown in FIG. 3A and a field (a) of FIG. 4, the contact members 41, 42 and 44 are retracted from the front-stage printing path for the base material BM. Further, the contact member 43 is mounted on the head part 2, but at a position higher than the long side 243 in the vertical direction Z. Therefore, the printing operation can be smoothly performed without any of the contact members 41 to 44 interfering with the base material BM.

In performing the purging process as part of maintenance, if the head part 2 and the cover member 30 approach each other as shown in FIG. 3B and the field (b) of FIG. 4, the contact members 41, 42 and 44 are held in close contact with the second lower surface peripheral edge portion 252 of the head part 2 and the contact member 43 is held in close contact with the upper end portion 331 while being held in close contact with the side surface parts 231 of the recording heads 23. Further, simultaneously, the one end part of the contact member 43 contacts the contact member 41 as shown in the partial enlarged view of FIG. 3B, and the other end part thereof also contacts the contact member 42 although not shown. In this way, a clearance between the head part 2 and the cover member 30 can be closed to seal the nozzle surface 21 from outside and enhance the airtightness of the atmosphere surrounding the nozzle surface 21 by the airtight controller 4 constituted by the contact members 41 to 44.

Further, the head part 2 is in the inclined posture and the nozzle surface 21 is inclined toward the left-lower side as shown in the field (b) of FIG. 4. Thus, if the purging process or the like is performed, the ink ejected from the nozzle surface 21 drips to the first lower surface peripheral edge portion 251 along the nozzle surface 21 and approaches the contact member 43 of the airtight controller 4. However, since the contact member 43 is located above the lower surface 24 while being separated from the lower surface 24 of the head part 2, similarly to the upper end portion 331 of the side wall 33, the ink dripping from the nozzle surface 21 is reliably collected into the collection space SP via the first lower surface peripheral edge portion 251 as shown by a broken-line arrow of FIG. 4. Therefore, the ink can be reliably prevented from being attached to the upper end portion 331 of the side wall 33 and the contact member 43 and solidified. As a result, the reattachment of the ink to the nozzle surface 21 can be effectively prevented and the printing process can be stably performed.

As just described, in this embodiment, the short sides 241, 242 respectively correspond to examples of a "first short side" and a "second short side" of the invention, and the long sides 243, 244 respectively correspond to examples of a "first long side" and a "second long side" of the invention. Further, out of the side walls 31 to 34 of the cover member 30, the side wall 33 corresponds to an example of a "first side wall" of the invention, whereas the remaining side walls 31, 32 and 34 correspond to an example of a "second side wall" of the invention. Further, the contact member 43 corresponds to an example of a "side surface contact member" of the invention, whereas the contact members 41, 42 and 44 correspond to an example of a "lower surface contact member" of the invention.

Figure 5:
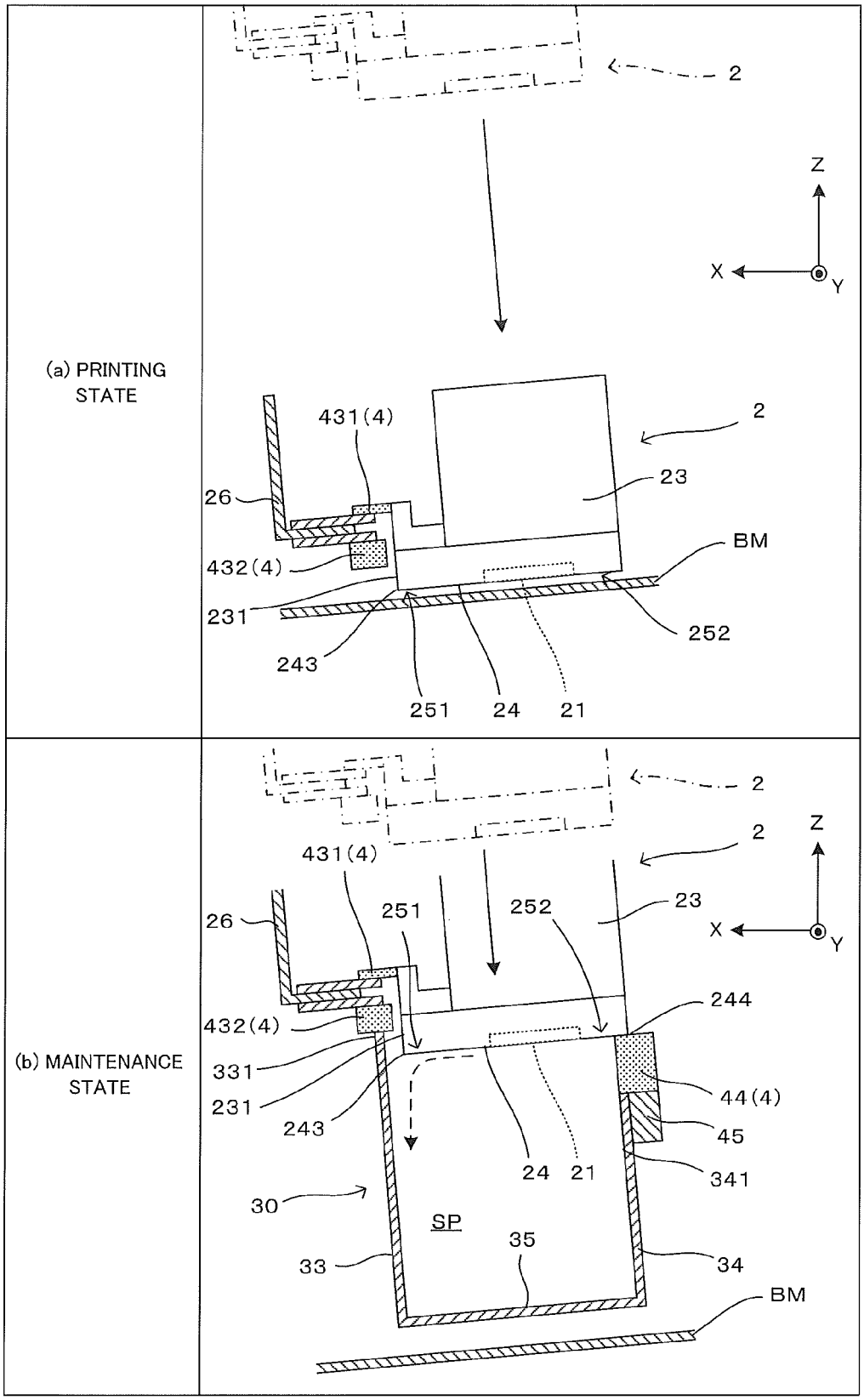
FIG. 5 is a diagram schematically showing the operations of a head part, a maintenance part and an airtight controller in a second embodiment of the printing apparatus according to the invention.

FIG. 5 includes views schematically showing the operations of a head part, a maintenance part and an airtight controller in a second embodiment of the printing apparatus according to the invention. The second embodiment largely differs from the first embodiment in the configuration of an airtight controller 4, particularly in the configuration of a contact member on the side of a first lower surface peripheral edge portion 251, and the other configuration and operations are basically the same as in the first embodiment. Accordingly, the following description is centered on points of difference and the same components are denoted by the same reference signs and not described.

In the second embodiment, two contact members 431, 432 are mounted on a guard member 26 of a head part 2, instead of the contact member 43 of the first embodiment. As shown in FIG. 5, the contact member 431 is mounted on the guard member 26 of the head part 2 while being held in close contact with a side surface part 231 of each recording head 23 at a position above the contact member 432, and corresponds to an example of a "first head contact member" of the invention. Further, the contact member 432 is mounted on the guard member 26 of the head part 2 with the lower surface thereof facing toward an upper end portion 331, and corresponds to an example of a "cover contact member" of the invention. However, the lower surface of the contact member 432 is located at a position higher than a long side 243 in a vertical direction Z.

In performing printing in a printing apparatus 100 thus configured, the head part 2 is positioned above a front-stage printing path for a base material BM as shown in a field (a) of FIG. 5. On the other hand, a maintenance part 3 waits at a position separated in a width direction Y from the front-stage printing path. Thus, contact members 41, 42 and 43 are retracted from the front-stage printing path for the base material BM. Further, the contact members 431, 432 are mounted on the head part 2, but at positions higher than the long side 243 in the vertical direction Z. Therefore, a printing operation can be smoothly performed without any of the contact members 41, 42, 44, 431 and 423 interfering with the base material BM.

In performing a purging process as part of maintenance, if the head part 2 and a cover member 30 approach each other as shown in a field (b) of FIG. 5, the contact members 41, 42 and 44 are held in close contact with a second lower surface peripheral edge portion 252 of the head part 2 and the contact member 432 is held in close contact with the upper end portion 331 as in the first embodiment. Further, simultaneously, one end part of the contact member 432 contacts the contact member 41 and the other end part thereof contacts the contact member 42 although not shown. In this way, in the second embodiment, a clearance between the head part 2 and the cover member 30 can be mostly closed to enhance the airtightness of an atmosphere surrounding a nozzle surface 21 by the airtight controller 4 constituted by the contact members 41, 42, 44, 431 and 432.

Further, also in the second embodiment, the upper end portion 331 of a side wall 33 on the side of the first lower surface peripheral edge portion 251 is separated from a lower surface 24 of the head part 2 and sealing on the side of the first lower surface peripheral edge portion 251 is performed with the contact members 431, 432 separated from the first lower surface peripheral edge portion 251 as in the first embodiment. Thus, an ink dripping from the nozzle surface 21 is reliably collected into a collection space SP via the first lower surface peripheral edge portion 251 as shown by a broken-line arrow of FIG. 5. Therefore, the ink can be reliably prevented from being attached to the upper end portion 331 of the side wall 33 and the contact member 432 and solidified. As a result, the reattachment of the ink to the nozzle surface 21 can be effectively prevented and a printing process can be stably performed.

Figure 6:
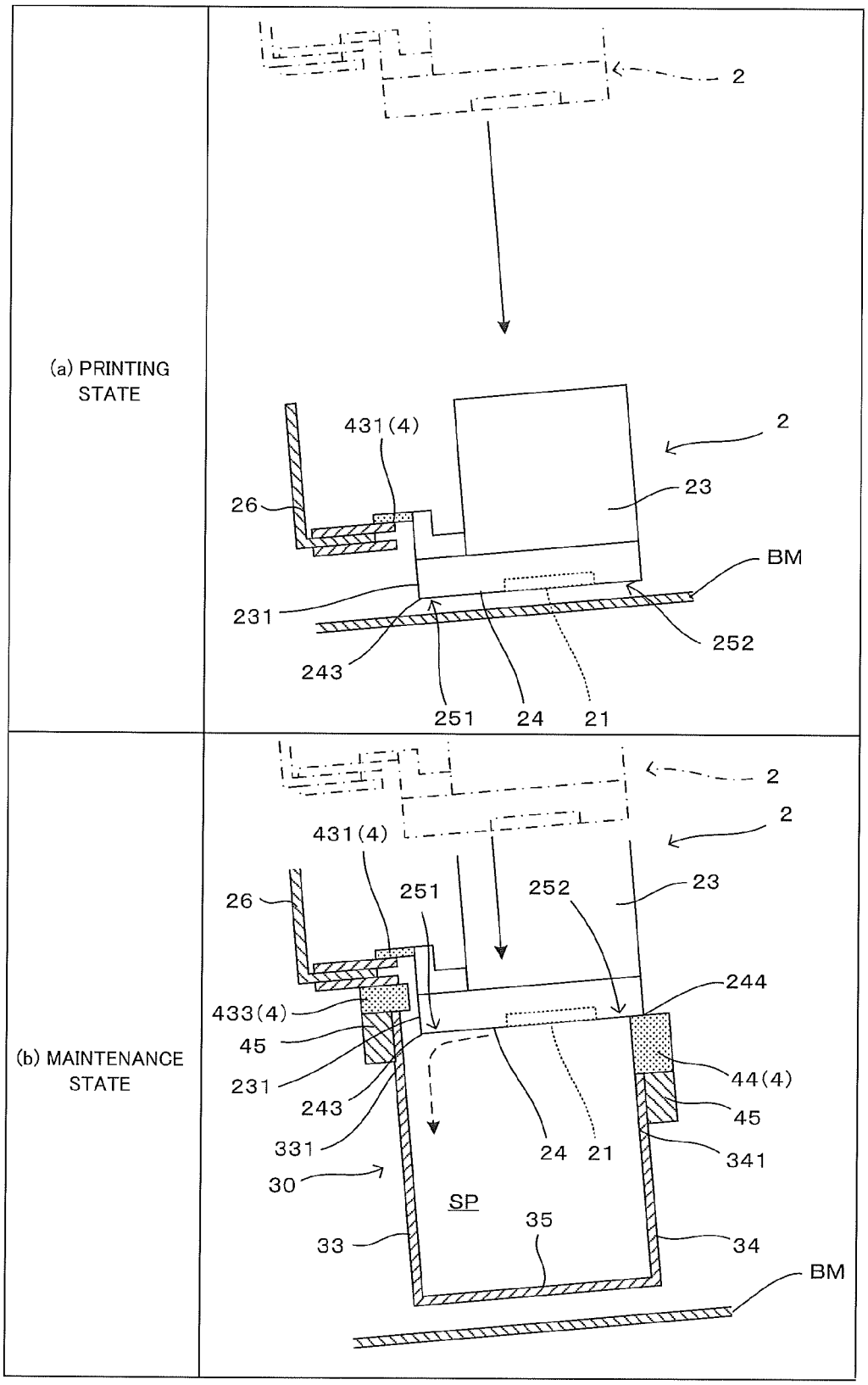
FIG. 6 is a diagram schematically showing the operations of a head part, a maintenance part and an airtight controller in a third embodiment of the printing apparatus according to the invention.

FIG. 6 includes views schematically showing the operations of a head part, a maintenance part and an airtight controller in a third embodiment of the printing apparatus according to the invention. The third embodiment largely differs from the second embodiment in the configuration of an airtight controller 4, particularly in the configuration of a contact member for closing a clearance between a side wall 33 and a head part 2, and the other configuration and operations are basically the same as in the second embodiment. Accordingly, the following description is centered on points of difference and the same components are denoted by the same reference signs and not described.

In the third embodiment, a contact member 433 functioning as a "second head contact member" of the invention is provided instead of the contact member 432 functioning as the "cover contact member" of the invention. This contact member 433 is mounted on the side wall 33 by a support member 45 in such a posture as to project further upward than an upper end portion 331 of the side wall 33 as shown in a field (b) of FIG. 6. Although not shown, one end part of the contact member 433 is in contact with a contact member 41 and the other end part thereof is in contact with a contact member 42. That is, an upper peripheral edge part of a cover member 30 is surrounded over the entire periphery by the contact members 41, 42, 44 and 433 made of rubber sponge and the cover member 30 moves in a width direction Y in this state In performing printing in a printing apparatus 100 thus configured, the head part 2 is positioned above a front-stage printing path for a base material BM as shown in a field (a) of FIG. 6. On the other hand, a maintenance part 3 waits at a position separated in a width direction Y from the front-stage printing path. Thus, the contact members 41, 42, 44 and 433 are retracted from the front-stage printing path for the base material BM. Further, the contact member 431 is mounted on the head part 2, but at a position higher than a long side 243 in a vertical direction Z. Therefore, a printing operation can be smoothly performed without any of the contact members 41, 42, 44, 431 and 433 interfering with the base material BM.

In performing a purging process as part of maintenance, if the head part 2 and the cover member 30 approach each other as shown in a field (b) of FIG. 6, the contact members 41, 42 and 44 are held in close contact with a second lower surface peripheral edge portion 252 of the head part 2 and the contact member 433 is held in close contact with the lower surface of a guard member 26 of the head part 2. In this way, in the third embodiment, a clearance between the head part 2 and the cover member 30 can be mostly closed to enhance the airtightness of an atmosphere surrounding a nozzle surface 21 by the airtight controller 4 constituted by the contact members 41, 42, 44, 431 and 433.

Further, also in the third embodiment, the upper end portion 331 of the side wall 33 on the side of a first lower surface peripheral edge portion 251 is separated from the lower surface 24 of the head part 2 and sealing on the side of the first lower surface peripheral edge portion 251 is performed with the contact members 431, 433 separated from the first lower surface peripheral edge portion 251 as in the second embodiment. Thus, an ink dripping from the nozzle surface 21 is reliably collected into a collection space SP via the first lower surface peripheral edge portion 251 as shown by a broken-line arrow of FIG. 6. Therefore, the ink can be reliably prevented from being attached to the upper end portion 331 of the side wall 33 and the contact member 433 and solidified. As a result, the reattachment of the ink to the nozzle surface 21 can be effectively prevented and a printing process can be stably performed.

Note that the invention is not limited to the embodiments described above and various changes other than the aforementioned ones can be made without departing from the gist of the invention. For example, although the elastic bodies constituting the contact members 41 to 44, 431 to 433 are constituted by rubber sponges in the above embodiments, other elastic bodies capable of being elastically deformed to close the clearance between the head part 2 and the cover member 30 may be used instead of the rubber sponges. Further, although the contact members 41 to 44, 431 to 433 are entirely constituted by the elastic bodies, only parts to be held in contact with the head part 2 and the cover member 30 may be constituted by elastic bodies. It is further desirable that parts of the contact members in contact with each other are also constituted by elastic bodies.

Further, in the above embodiments, the invention is applied to a case where the head part 2 is in such an inclined posture that the long side 243 located on a downstream side in the conveying direction of the base material BM is lower in the vertical direction Z than the long side 244 on an upstream side (two head parts 2 located on a downstream side in the front-stage printer 110). However, the invention can be also applied to a case where the head part 2 is in an inclined posture inclined toward an opposite side (three head parts 2 located on an upstream side in the front-stage printer 110 and a head part in the rear-stage printer 130).

Further, although the head driver 29 and the maintenance driver 39 constitute the "mover" of the invention and a switch is made between the printing state and the maintenance state by these in the above embodiments, a switch may be made between the printing state and the maintenance state by moving only the head part 2 by the head driver 29 while fixedly arranging the maintenance part 3.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

This invention is generally applicable to a printing apparatus for printing by ejecting ink from a nozzle surface provided in a head part in an inclined posture.

What is claimed is:

1. A printing apparatus for printing by discharging an ink to an upper surface of a base material in the form of an elongated strip, the apparatus comprising:

a head part provided with a nozzle surface for ejecting the ink in a central part of a lower surface having a rectangular shape;

a cover member having a box shape open upward by having a plurality of side walls rising upward from a periphery of an inner bottom surface, the cover member covering the nozzle surface from below by being arranged below the head part;

a mover configured to relatively move the head part and the cover member to switch to a maintenance state for covering the head part from below by the cover member and a printing state for enabling the printing by retracting the cover member from a position below the head part; and an airtight controller configured to enhance airtightness of an atmosphere surrounding the nozzle surface by closing at least a part of a clearance formed between the head part and the cover member in the maintenance state, wherein:

the lower surface has a first short side and a second short side parallel to a longitudinal direction of the base material and a first long side and a second long side parallel to a width direction of the base material, the head part is arranged in such an inclined posture that the first long side is located below the second long side in a vertical direction and a first lower surface peripheral edge portion extending along the first long side, out of a peripheral edge part of the lower surface, is located vertically lowest, the plurality of side walls include a first side wall having an upper end portion located away from the first long side toward a side opposite to the second long side in the longitudinal direction, the plurality of side walls of the cover member include a second side wall having an upper end portion located vertically below a second lower surface peripheral edge portion except the first lower surface peripheral edge portion, out of the peripheral edge part of the lower surface, the airtight controller includes a side surface contact member to be interposed between a side surface part of the head part extending upward from the first long side and the upper end portion of the first side wall of the cover member while being separated from the first lower surface peripheral edge portion, and a lower surface contact member which is, in the maintenance state, interposed between the second lower surface peripheral edge portion and the cover member, and the airtight controller seals the nozzle surface from outside by bringing the lower surface contact member and the side surface contact member into close contact with each other.

2. The printing apparatus according to claim 1, wherein:

the side surface contact member is mounted on the head part while being held in close contact with the side surface part, and held in close contact with the upper end portion of the first side wall in the maintenance state, and the lower surface contact member is mounted on the upper end portion of the second side wall and held in close contact with the second lower surface peripheral edge portion in the maintenance state.

3. The printing apparatus according to claim 2, wherein:

at least a region to be held in close contact with the upper end portion of the first side wall, out of the side surface contact member, is constituted by an elastic body, and at least a region to be held in close contact with the second lower surface peripheral edge portion, out of the lower surface contact member, is constituted by an elastic body.

4. The printing apparatus according to claim 1, wherein:

the plurality of side walls include a second side wall having an upper end portion located vertically below a second lower surface peripheral edge portion except the first lower surface peripheral edge portion, out of the peripheral edge part of the lower surface, and the airtight controller includes a first head contact member mounted on the head part and to be held in close contact with a side surface part of the head part while being separated from the first lower surface peripheral edge portion, a cover contact member mounted on the head part while facing the upper end portion of the first side wall and to be held in close contact with the upper end portion of the first side wall in the maintenance state, and a lower surface contact member mounted on the upper end portion of the second side wall and to be held in close contact with the second lower surface peripheral edge portion in the maintenance state, and the airtight controller brings the lower surface contact member and the cover contact member into close contact with each other.

5. The printing apparatus according to claim 4, wherein:

at least regions to be held in close contact with the upper end portion of the first side wall in the first head contact member and the cover contact member are constituted by elastic bodies, and at least a region to be held in close contact with the second lower surface peripheral edge portion, out of the lower surface contact member, is constituted by an elastic body.

6. A printing apparatus according to claim 1, wherein:

the plurality of side walls include a second side wall having an upper end portion located vertically below a second lower surface peripheral edge portion except the first lower surface peripheral edge portion, out of the peripheral edge part of the lower surface, and the airtight controller includes a first head contact member mounted on the head part and to be held in close contact with a side surface part of the head part while being separated from the first lower surface peripheral edge portion, a second head contact member mounted on the upper end portion of the first side wall and to be held in close contact with the head part in the maintenance state to close a clearance between the head part and the upper end portion of the first side wall, and a lower surface contact member mounted on the upper end portion of the second side wall and to be held in close contact with the second lower surface peripheral edge portion in the maintenance state, and the airtight controller brings the lower surface contact member and the second head contact member into close contact with each other.

7. The printing apparatus according to claim 6, wherein:

at least regions to be held in close contact with the head part in the first head contact member and the second head contact member are constituted by elastic bodies, and at least a region to be held in close contact with the second lower surface peripheral edge portion, out of the lower surface contact member, is constituted by an elastic body.

8. A printing apparatus for printing by discharging an ink to an upper surface of a base material in the form of an elongated strip, the apparatus comprising:

a head part provided with a nozzle surface for ejecting the ink in a central part of a lower surface having a rectangular shape;

a cover member having a box shape open upward by having a plurality of side walls rising upward from a periphery of an inner bottom surface, the cover member covering the nozzle surface from below by being arranged below the head part;

a mover configured to relatively move the head part and the cover member to switch to a maintenance state for covering the head part from below by the cover member and a printing state for enabling the printing by retracting the cover member from a position below the head part;

an airtight controller configured to enhance airtightness of an atmosphere surrounding the nozzle surface by closing at least a part of a clearance formed between the head part and the cover member in the maintenance state, wherein:

the lower surface has a first short side and a second short side parallel to a longitudinal direction of the base material and a first long side and a second long side parallel to a width direction of the base material, the head part is arranged in such an inclined posture that the first long side is located below the second long side in a vertical direction and a first lower surface peripheral edge portion extending along the first long side, out of a peripheral edge part of the lower surface, is located vertically lowest, the plurality of side walls include a first side wall having an upper end portion located away from the first long side toward a side opposite to the second long side in the longitudinal direction, the plurality of side walls include a second side wall having an upper end portion located vertically below a second lower surface peripheral edge portion except the first lower surface peripheral edge portion, out of the peripheral edge part of the lower surface, the airtight controller includes a first head contact member mounted on the head part and to be held in close contact with a side surface part of the head part while being separated from the first lower surface peripheral edge portion, a cover contact member mounted on the head part while facing the upper end portion of the first side wall and to be held in close contact with the upper end portion of the first side wall in the maintenance state, and a lower surface contact member mounted on the upper end portion of the second side wall and to be held in close contact with the second lower surface peripheral edge portion in the maintenance state, and the airtight controller brings the lower surface contact member and the cover contact member into close contact with each other.

9. The printing apparatus according to claim 8, wherein:

at least regions to be held in close contact with the upper end portion of the first side wall in the first head contact member and the cover contact member are constituted by elastic bodies, and at least a region to be held in close contact with the second lower surface peripheral edge portion, out of the lower surface contact member, is constituted by an elastic body.

10. A printing apparatus for printing by discharging an ink to an upper surface of a base material in the form of an elongated strip, the apparatus comprising:

a head part provided with a nozzle surface for ejecting the ink in a central part of a lower surface having a rectangular shape;

a cover member having a box shape open upward by having a plurality of side walls rising upward from a periphery of an inner bottom surface, the cover member covering the nozzle surface from below by being arranged below the head part;

a mover configured to relatively move the head part and the cover member to switch to a maintenance state for covering the head part from below by the cover member and a printing state for enabling the printing by retracting the cover member from a position below the head part;

an airtight controller configured to enhance airtightness of an atmosphere surrounding the nozzle surface by closing at least a part of a clearance formed between the head part and the cover member in the maintenance state, wherein:

the lower surface has a first short side and a second short side parallel to a longitudinal direction of the base material and a first long side and a second long side parallel to a width direction of the base material, the head part is arranged in such an inclined posture that the first long side is located below the second long side in a vertical direction and a first lower surface peripheral edge portion extending along the first long side, out of a peripheral edge part of the lower surface, is located vertically lowest, the plurality of side walls include a first side wall having an upper end portion located away from the first long side toward a side opposite to the second long side in the longitudinal direction, the plurality of side walls include a second side wall having an upper end portion located vertically below a second lower surface peripheral edge portion except the first lower surface peripheral edge portion, out of the peripheral edge part of the lower surface, the airtight controller includes a first head contact member mounted on the head part and to be held in close contact with a side surface part of the head part while being separated from the first lower surface peripheral edge portion, a second head contact member mounted on the upper end portion of the first side wall and to be held in close contact with the head part in the maintenance state to close a clearance between the head part and the upper end portion of the first side wall, and a lower surface contact member mounted on the upper end portion of the second side wall and to be held in close contact with the second lower surface peripheral edge portion in the maintenance state, and the airtight controller brings the lower surface contact member and the second head contact member into close contact with each other.

11. The printing apparatus according to claim 10, wherein:

at least regions to be held in close contact with the head part in the first head contact member and the second head contact member are constituted by elastic bodies, and at least a region to be held in close contact with the second lower surface peripheral edge portion, out of the lower surface contact member, is constituted by an elastic body.

* * * * *